US007887252B1

(12) United States Patent
Wang

(10) Patent No.: US 7,887,252 B1
(45) Date of Patent: Feb. 15, 2011

(54) WATERPROOF MANHOLE ASSEMBLY ASSISTED BY HYDRAULIC DEVICE

(76) Inventor: Tsung-Hua Wang, P.O. Box 166-13, Taipei (TW) 115

( * ) Notice: Subject to any disclaimer, the term of this patent is extended or adjusted under 35 U.S.C. 154(b) by 0 days.

(21) Appl. No.: 12/610,355

(22) Filed: Nov. 2, 2009

(51) Int. Cl.
*E02D 29/14* (2006.01)

(52) U.S. Cl. ..... 404/25

(58) Field of Classification Search ..... 404/25, 404/26; 52/20; 137/371
See application file for complete search history.

(56) References Cited

U.S. PATENT DOCUMENTS

| | | | | | |
|---|---|---|---|---|---|
| 314,781 | A * | 3/1885 | Beckwith | 404/25 |
| 1,992,354 | A * | 2/1935 | Coleman | 16/287 |
| 5,507,590 | A * | 4/1996 | Argandona | 404/25 |
| 5,788,406 | A * | 8/1998 | Hernandez | 404/25 |
| 5,941,024 | A * | 8/1999 | Journault | 52/20 |
| 5,950,368 | A * | 9/1999 | Bradford | 52/20 |
| 6,715,715 | B1 * | 4/2004 | Petersen | 244/114 R |
| 7,094,000 | B2 * | 8/2006 | Akkala et al. | 404/25 |
| 7,108,447 | B2 * | 9/2006 | Akkala et al. | 404/25 |
| 7,448,512 | B2 * | 11/2008 | Hauer et al. | 220/817 |
| 7,744,304 | B2 * | 6/2010 | Akkala et al. | 404/25 |
| 2008/0098662 | A1 * | 5/2008 | Laffitte Figueras | 52/20 |

* cited by examiner

*Primary Examiner*—Gary S Hartmann

(57) ABSTRACT

A semi-automatic manhole assembly assisted by a hydraulic device consists essentially of a circular frame (1), a cover (2) provided on the top, a hydraulic device (3) and a supporting unit (5) provide therebetween and jointed with both the frame (1) and cover (2) respectively, and a locking mechanism (4) disposed on an opposite end of the hydraulic device (3) and supporting unit (5) for sealing the cover (2) and frame (1) tightly. The supporting unit (5) is partially concealed within a trough (2), disposed at the bottom of the frame (1), and the hydraulic device (3) is prestored with pressure to lift the cover (2) when the locking mechanism (4) is released.

11 Claims, 5 Drawing Sheets

WATERPROOF MANHOLE ASSEMBLY ASSISTED BY HYDRAULIC DEVICE

FIELD OF THE INVENTION

The present invention relates to a waterproof manhole assembly equipped with a hydraulic system for lifting the manhole cover with less strength.

BACKGROUND OF THE INVENTION

A manhole is usually placed in street as a top opening for providing easy access and maintenance to the underground structure such as pipe line or sewer. The manhole is sealed by a manhole cover to avoid the falling of pedestrian or object. As shown in FIG. 5, a traditional manhole assembly may consists of a skirt (72) and a manhole cover (71), seated on a shoulder of the skirt (72). The manhole cover is commonly made of solid steel to support the weight of vehicles which pass over everyday. However, heavy cover also requires greater strength when it has to be removed. Maintenance staff is usually equipped with basic tool such as crowbar to lift the lid. A hole (73) is set on the cover (71) for receiving and engaging the tool. By assistance of the tool, the force needed to remove the cover is slightly reduced but it still requires a strong person for operating; and the disengagement of the crowbar with cover may injure the worker. Further, a slit (74) is usually kept for the expansion of metal cover (71), said slit (74) is easily clogged with matter (75), such as dust or other impurity, making the cover (71) being difficult to be opened. Moreover, the traditional manhole assembly doesn't provide any waterproof feature, which may allow liquid penetrate the manhole, corroding and damaging the equipment or device therein, and endangering the safety of the personnel who performs maintenance. Therefore, to provide a manhole cover heavy to bear the car passing by and easy to lift with water tight feature has become the objectives of the present invention.

SUMMARY OF THE INVENTION

To achieve foregoing objectives, the manhole assembly of the present invention comprises mainly a circular frame (1), a cover (2), a hydraulic device (3) and a supporting unit (5). Said frame (1) and cover (2) are connected by the hydraulic device (3) and the supporting unit (5). The supporting unit (5) of the present invention is an U-shape bracket, provided eccentrically at aside of the cover (2) and frame (1), whose one end is inserted into a trough (12) and jointed with the frame (1), and another end is fastened to the cover (2) for opening and sealing thereof. The hydraulic device (3), such as a hydraulic cylinder is provided at the same side as the supporting unit (5). The one end of the hydraulic device (3) is attached to the bottom of the trough (12) and another end attached to the bottom of the cover (2). A locking mechanism (4) is provided at the opposite side of the hydraulic device (3) and supporting unit (5) for maintaining the cover (2) in sealed state. Said locking mechanism (4) includes a hole (21) provided on the cover (2), a locking unit (41) disposed inside the hole (21), a support (43) provided with a passage hole (42) for receiving the locking unit (41) and a gasket (44) engaged with the locking unit (41). When said locking mechanism (4) is released, the hydraulic force of the hydraulic device (3) can lift the cover (2) to open, thus the user requires only a minimum amount of force to pull and open the manhole cover (2) made of heavy steel. As for the waterproof feature, the frame (1) of the present invention includes a groove (14) which a sealing ring (15) is embedded therein. Said groove (14) is disposed within the coverage of the cover (2), thus when the cover (2) is lowered down, the edge thereof engages with the groove (14). The groove (14) can serve as a slit and the sealing ring (15) is set to prevent any liquid or substance such as dust or gravel penetrating or clogging the manhole opening.

DETAILED DESCRIPTION OF PREFERRED EMBODIMENT

Figure 1:
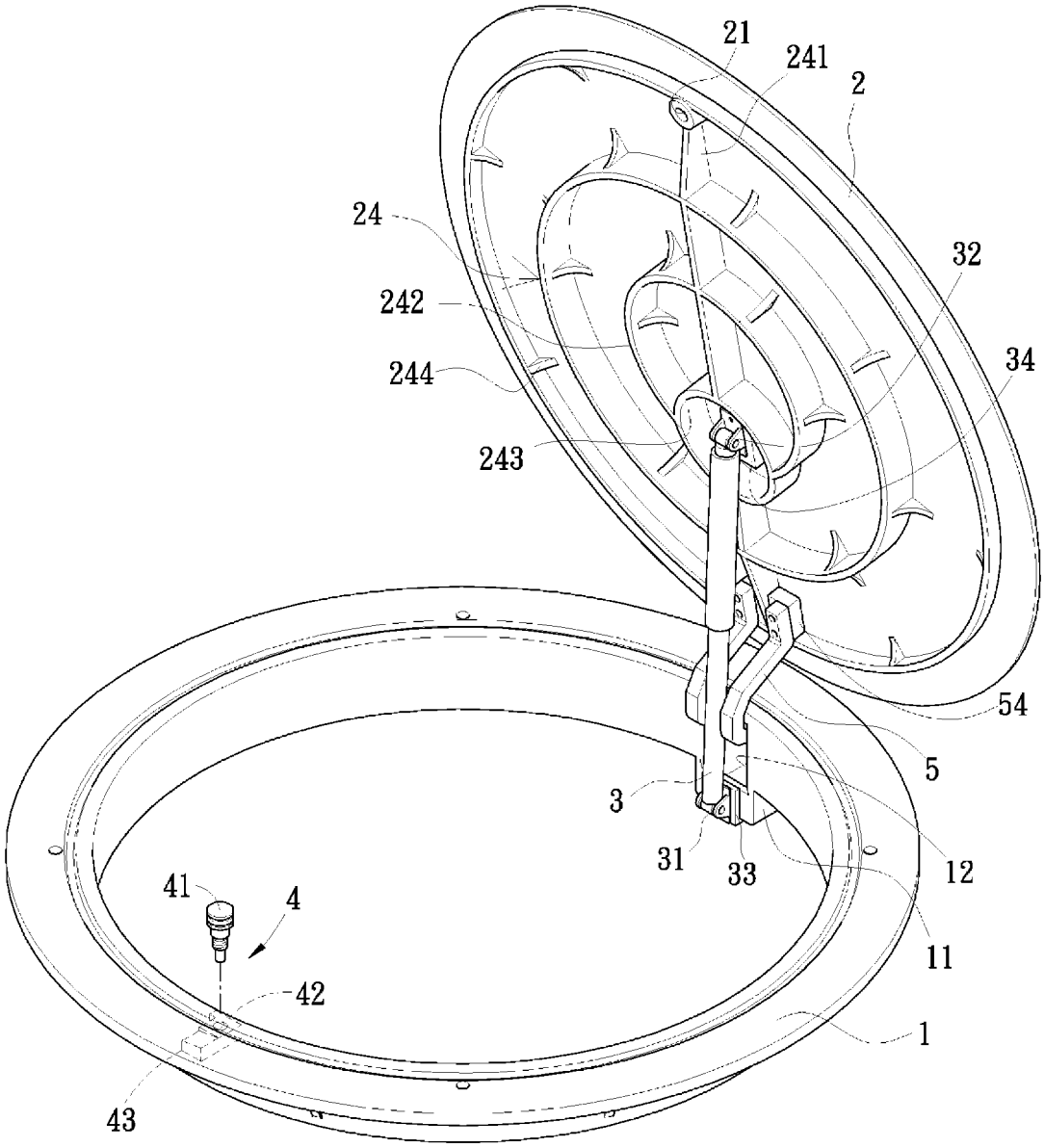
FIG. 1 is a perspective view of the preferred embodiment of the present invention.

Referring to FIGS. 1-4, an easy-lift and waterproof manhole assembly consists of a circular manhole frame (1) and a manhole cover (2). The manhole assembly is characterized in that a supporting unit (5) is provided at a side of the frame (1) and the cover (2). A first end of the supporting unit (5) is fixed securely onto a bottom side of the cover (2) and a second end thereof is coupled with a trough (12), provided at said frame (1). A hydraulic device (3) is provide at the same side as the supporting unit (5) and two distal ends thereof are jointed with the frame and cover (1, 2) respectively; and a locking mechanism (4) is disposed on an opposite end of the supporting unit (5) for sealing the cover (2) and frame (1) tightly.

Figure 2:
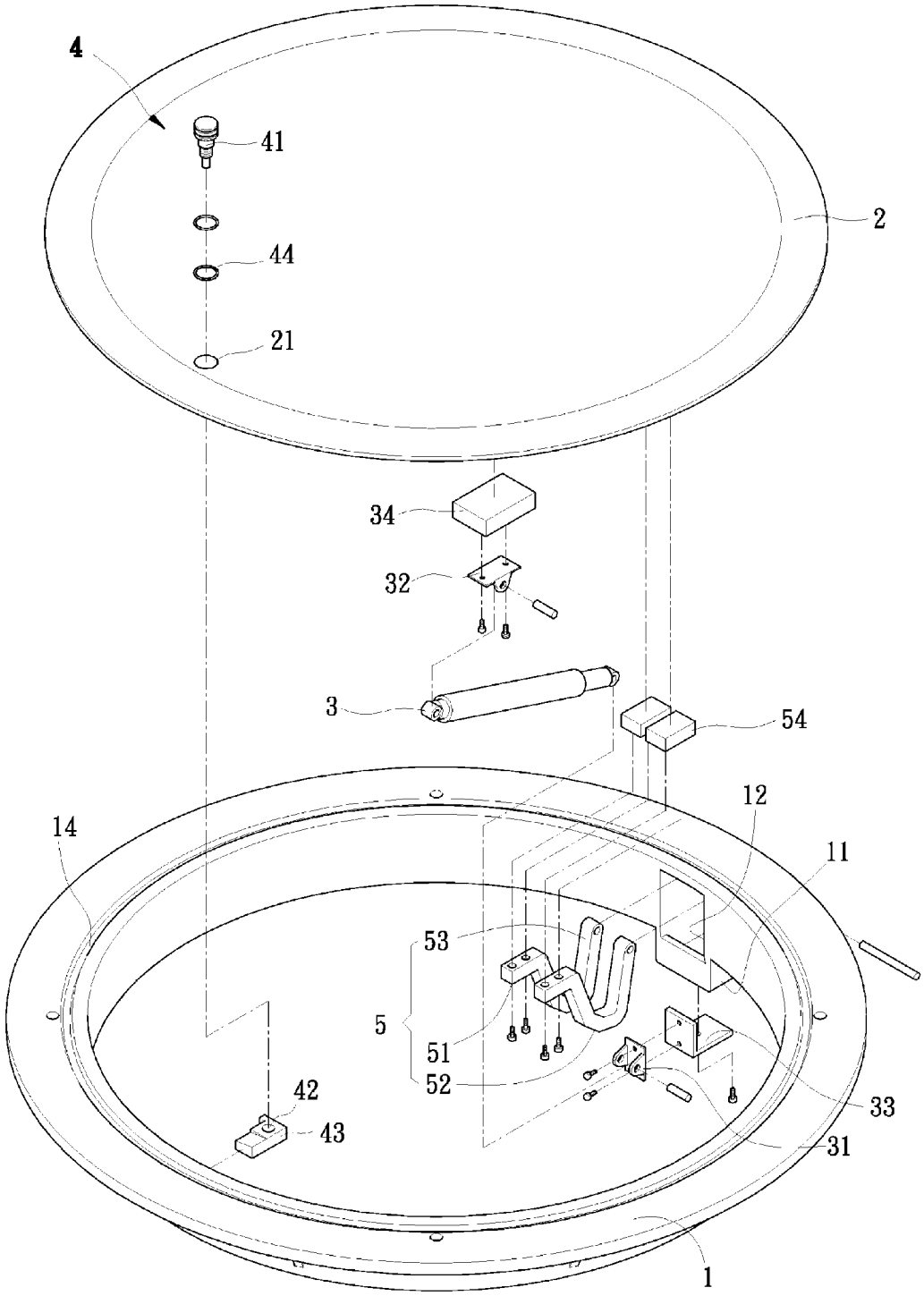
FIG. 2 is an exploded view of the preferred embodiment of the present invention.

The trough (12) has an opening disposed at an inner side of the frame (1) and a projected portion (11) is provided on a bottom thereof. As shown in FIG. 2, the supporting unit (5) consists of two symmetrical a left and right U-shaped brackets whose the second ends of both are inserted into the trough (12) and engaged respectively with a left and right side walls of the trough (12). Said hydraulic device (3) is provided between said right and left brackets of the supporting unit (5), and the lower side thereof is attached with the wall of the projected portion (11).

Figure 3:
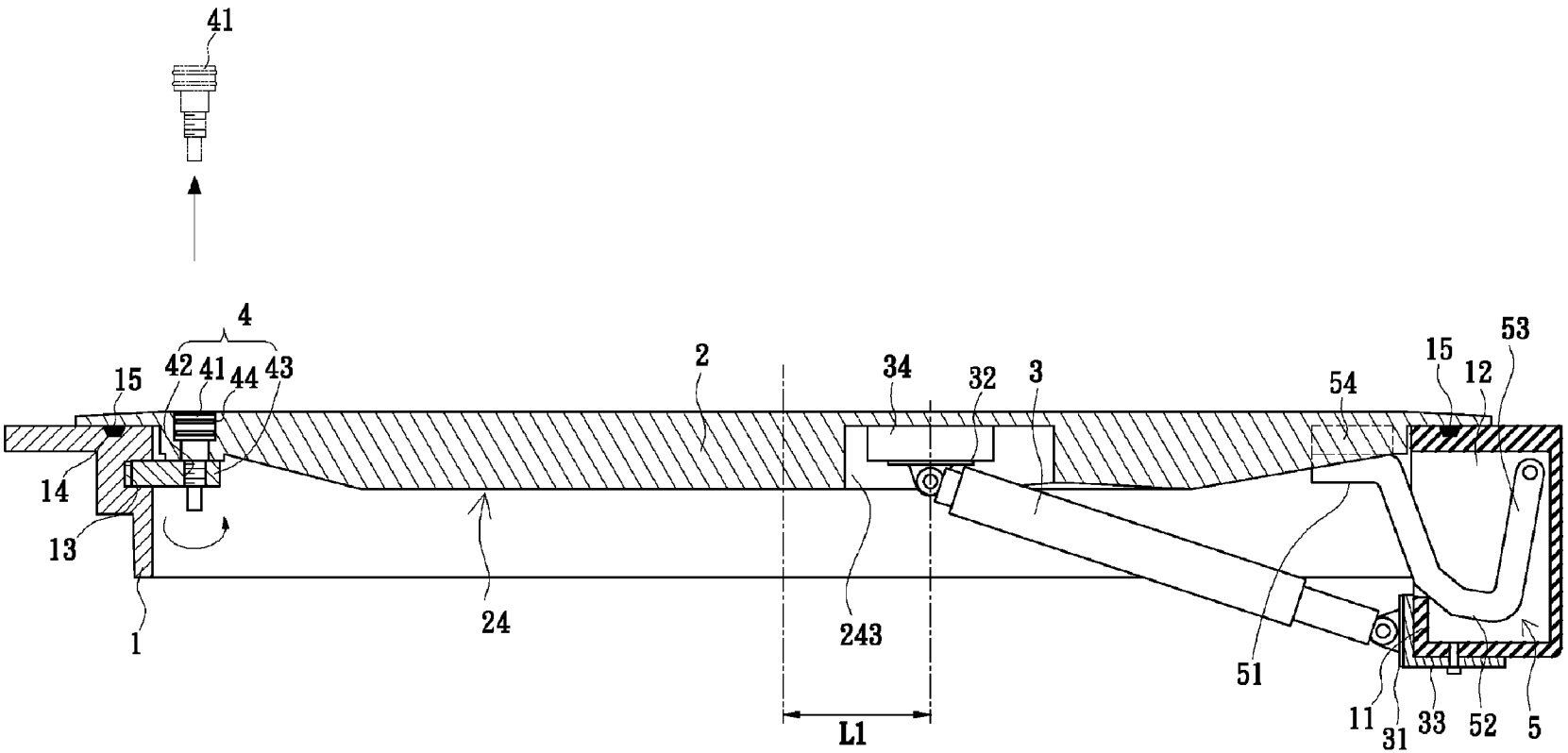
FIG. 3 is a cross sectional view of the preferred embodiment of the present invention.

As shown in FIG. 3, when the cover (2) is lowered to seal the opening, the supporting unit (5) is concealed inside the trough (12) to prevent corrosion and jamming the mechanism. The projection portion (11) disposed at the bottom (12) serves as a sustainer to support the hydraulic device (3) when is compressed.

Said hydraulic device (3) contains prestore pressure within. When the cover (2) is lowered and seals the manhole, said pressure is compressed inside the cylinder of the device; thus when the locking mechanism (4) is released, the compressed pressure within the hydraulic device (3) pushes the shaft upward, reaches its original state and lifts the cover (2). The pressure of the hydraulic device (3) is ideally and preferably determined less than the weight of the manhole cover (2) to avoid the cover (2) being lifted violently and harming the user close.

As illustrated in FIGS. 2 and 3, said locking mechanism (4) includes a hole (21) provided on the cover (2), a locking unit (41) disposed inside the hole (21), a support (43) provided with a passage hole (42) for receiving the locking unit (41)

and a gasket (44) engaged with the locking unit (41). Once the locking unit (41) passes the hole (21) and screw jointed with the passage hole (42) of the support (43), the cover (2) and frame (1) are securely sealed. The gasket (44) disposed around the locking unit (41) can prevent the liquid penetrating from the hole (21) as part of the waterproof feature.

The supporting unit (5) as shown in FIG. 2, comprises of a flat portion (51), attached with said cover (2), a U-shaped curved portion (52) and a jointed portion (53), pin jointed with the trough (12). Said flat, curved and jointed portions (51, 52, 53) are coupled by integrated molding.

The first and second ends of said hydraulic device (3) are pin jointed respectively with a lower mounting bracket (31), which is disposed at a bottom of the projected portion (11), and an upper mounting bracket (32), which is disposed at the bottom of the cover (2).

An L-shape adjusting unit (33) is provided between the lower mounting bracket (31) and projected portion (11). As shown in FIGS. 2 and 3, the adjusting unit (33) is screwed jointed with the projected portion (11). Although it was not illustrated, the hole provided on the adjusting unit for receiving the screw can be defined larger, providing limited adjustment for the adjusting unit (33) to prevent the hydraulic device (3) colliding with the supporting unit (5).

Referring to FIG. 1, the bottom of the cover (2) includes a reinforce structure (24). Said reinforce structure (24) consists of a diametrical beam (241) crossing the bottom of the cover (2), various circular girders (242) provided by a concentric fashion and an eccentric circular girder (243), provided away from the center of the cover (2) by a predetermined distance (L), as shown in FIG. 3. The aforementioned upper mounting bracket (32) which attached with the hydraulic device (3) is received inside said circular girder (243). Since the circular girder (243) is away from the centre of the cover (2) and the hydraulic device (3) is provided about the supporting the unit (5), the length of hydraulic device (3) is shorter than the radius of the cover (2), and under such design, user is allowed to have broader space when entering the manhole opening, as illustrated in FIG. 4.

Figure 4:
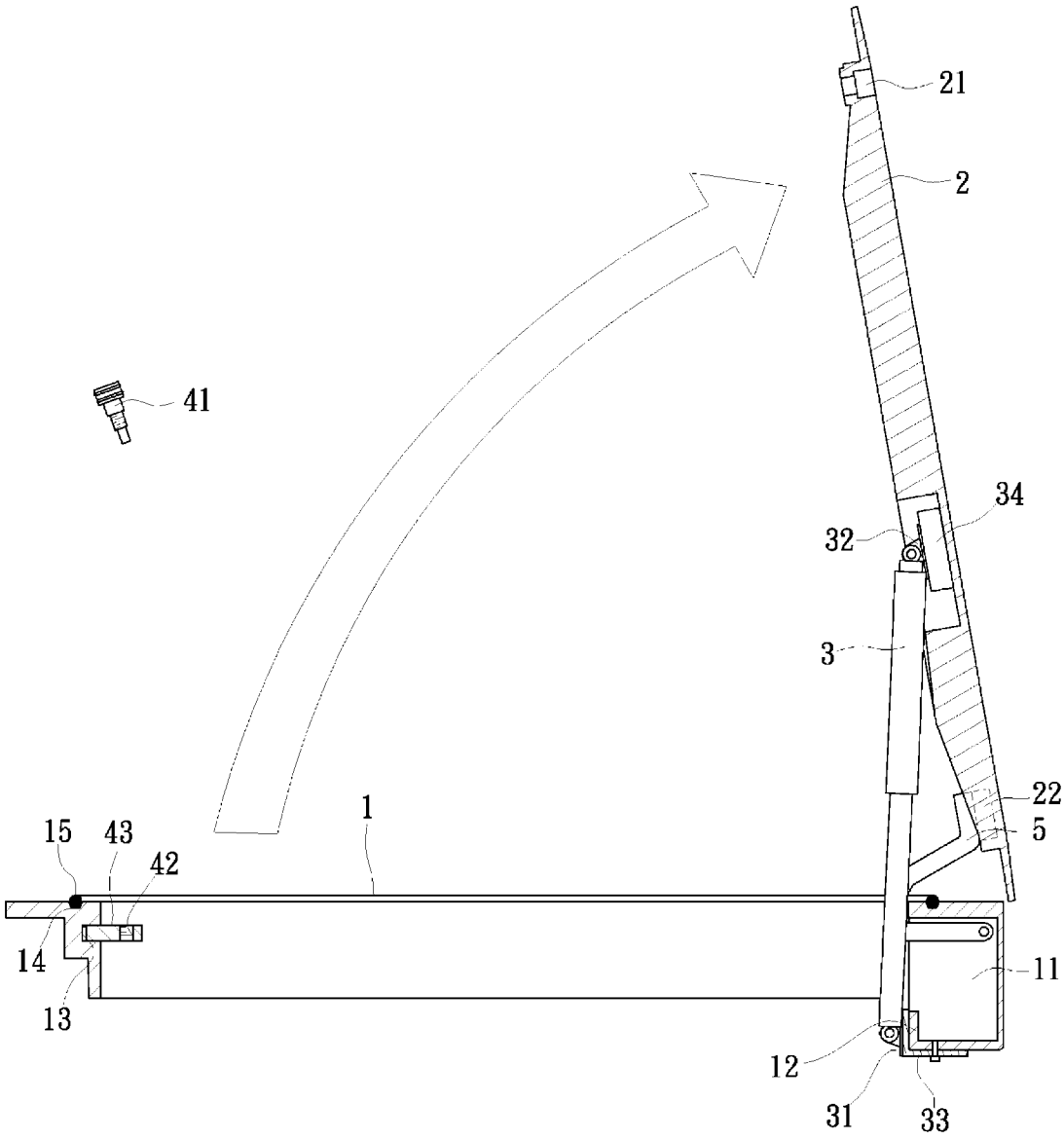
FIG. 4 is a side elevational view of the preferred embodiment of the present invention showing the opening of the manhole covered assisted by a hydraulic device and supporting unit.
Figure 5:
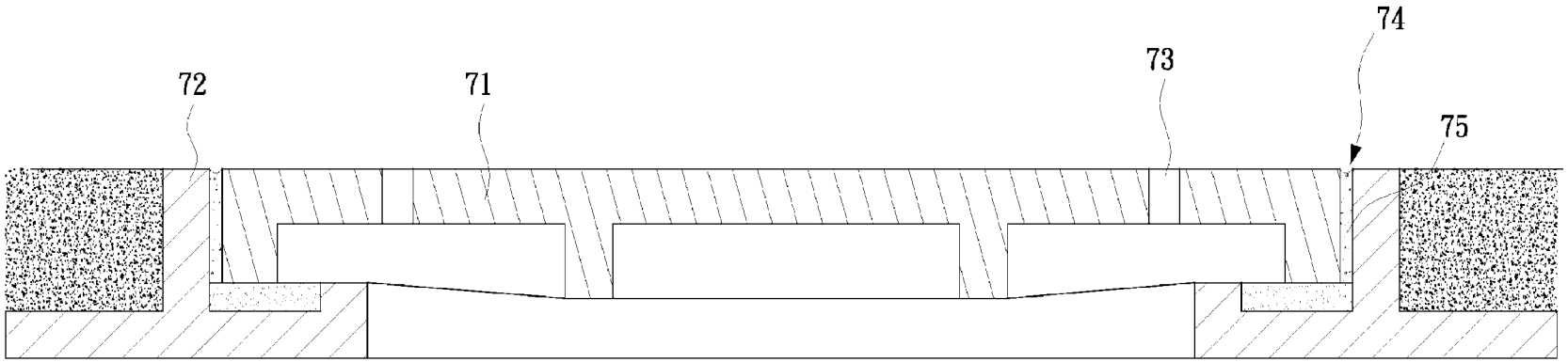
Prior Art Fig. 5
FIG. 5 is a cross sectional view of a conventional manhole assembly.

With reference to FIG. 2 through FIG. 4, a first sleeper block (54) is provided between the flat portion (51) of the supporting unit (5) and the cover (2), and a second sleeper block (34) is provided between the upper mounting bracket (32) and the cover (2). Said first and second sleeper blocks (54, 34) can avoid the damage of structure of cover (2) by screw jointing flat portion (51) and upper mounting bracket (32) directly to the bottom of the cover (2). Further, the first and second sleeper blocks (54, 34) provide adjustment feature for installing hydraulic device (3) and supporting units (5) of different specifications.

A circular groove (14) is provided on the upper surface of the frame (1) within the coverage of the cover (2). Since the manhole assembly of the present invention is provided with waterproof feature, thus the frame (1) and cover (2) will be tightly sealed which leads to a near vacuum state and makes the cover (2) difficult to be lifted. The groove (14) filled with air can prevent mentioned disadvantage and since the groove (14) is set within the coverage of the manhole cover (2), dust or substance is less possible resided therein. A sealing ring (15) is further embedded in said groove (14) as a precaution measure to improve the waterproof feature of the present invention.

As illustrated in FIGS. 3 and 4, when a maintenance personnel needs to gain access to the underground structure to perform the duty, He or she only needs to release the locking unit (41) to disengage the manhole cover (2) from the manhole frame (1). The hydraulic device (3) which both end are attached to the cover (2) and frame (1) will provide an auxiliary force to lift the cover (2), so the user requires only small amount of strength to open the lid and when the duty is over, user can close the lid as easy as to open it and reengage the locking unit (41) to close the cover (2).

The invention claimed is:

1. An easy-lift and waterproof manhole assembly comprising a circular frame (1) and a cover (2) characterized in that:

A supporting unit (5) is provided at a side of the frame (1) and the cover (2); a first end of the supporting unit (5) is fixed securely onto a bottom side of the cover (2) and a second end thereof is coupled with a trough (12), provided on said frame (1); a hydraulic device (3) is provided at a same side as the supporting unit (5) and a first and second ends thereof jointed with the frame and cover (1, 2) respectively, and a locking mechanism (4) is disposed on an opposite end of the supporting unit (5) for sealing the cover (2) and frame (1) tightly; said hydraulic device (3) contains a prestored pressure for lifting the cover (2) when the locking mechanism is released.

2. An easy-lift and waterproof manhole assembly of claim 1 wherein an opening of the trough (12) is disposed at an inner side of the frame (1) and a projected portion (11) is fastened on a bottom of the trough (12); said supporting unit (5) includes a left and right portions whose the second ends of both left and right portions are inserted into the trough (12) and engaged with a left and right side walls thereof; said hydraulic device (3) is provided between said right and left portions of the supporting unit (5), and the second end of the hydraulic device (3) is jointed with a frontal wall of said projected portion (11).

3. An easy-lift and waterproof manhole assembly of claim 1 wherein said locking mechanism (4) including a hole (21) provided on the cover (2), a locking unit (41) accommodated in the hole (21), a support (43) provided with a passage hole (42) for receiving the locking unit (41) and a gasket (44) engaged with the locking unit (41).

4. An easy-lift and waterproof manhole assembly of claim 1 wherein the supporting unit (5) comprising a flat portion (51), attached with said cover (2), an U-shape curved portion (52) and a jointed portion (53) jointed with the trough (12); said flat, curved and jointed portions (51, 52, 53) are coupled by integrated molding.

5. An easy-lift and waterproof manhole assembly of claim 2 wherein said first and second ends of said hydraulic device (3) is jointed respectively with a lower mounting bracket (31), disposed at a bottom of the projected portion (11), and a upper mounting bracket (32), disposed at the bottom of the cover (2).

6. An easy-lift and waterproof manhole assembly of claim 5 wherein a L-shape adjusting unit (33) is provided between the lower mounting bracket (31) and projected portion (11).

7. An easy-lift and waterproof manhole assembly of claim 5 wherein a reinforce structure (24) is provided on the bottom of the cover (2); said reinforce structure (24) includes a diametrical beam (241), a pluralities of concentric circular girders (242) and an eccentric circular girder (243) provided about a center of the cover (2); said upper mounting bracket (32) is received inside said circular girder (243).

8. An easy-lift and waterproof manhole assembly of claim 5 wherein a first sleeper block (54) is provided between the supporting unit (5) and the cover (2), and a second sleeper block (34) is provided between the upper mounting bracket (32) and the cover (2).

9. An easy-lift and waterproof manhole assembly of claim 7 wherein a first sleeper block (54) is provided between the supporting unit (5) and the cover (2), and a second sleeper block (34) is provided between the upper mounting bracket (32) and the cover (2).

10. An easy-lift and waterproof manhole assembly of claim 1 wherein said frame (1) includes a groove (14) disposed within the coverage of the cover (2).

11. An easy-lift and waterproof manhole assembly of claim 9 wherein a sealing ring (15) is embedded in said groove (14).

* * * * *